US009084498B2

(12) United States Patent
Maddux

(10) Patent No.: US 9,084,498 B2
(45) Date of Patent: Jul. 21, 2015

(54) COLLAPSIBLE FOOD SERVICE SYSTEM

(75) Inventor: Larry Maddux, Westminster, CA (US)

(73) Assignee: Cambro Manufacturing Company, Huntington Beach, CA (US)

( * ) Notice: Subject to any disclaimer, the term of this patent is extended or adjusted under 35 U.S.C. 154(b) by 219 days.

(21) Appl. No.: 13/194,061

(22) Filed: Jul. 29, 2011

(65) Prior Publication Data

US 2011/0302953 A1 Dec. 15, 2011

Related U.S. Application Data

(62) Division of application No. 12/615,964, filed on Nov. 10, 2009.

(51) Int. Cl.

| | |
|---|---|
| ***A47F 10/06*** | (2006.01) |
| ***F25D 3/08*** | (2006.01) |
| *A47F 3/04* | (2006.01) |

(52) U.S. Cl.

CPC . *A47F 10/06* (2013.01); *F25D 3/08* (2013.01); *A47F 3/0491* (2013.01); *A47F 2010/065* (2013.01); *F25D 2303/0831* (2013.01); *F25D 2303/0845* (2013.01); *F25D 2303/08222* (2013.01); *F25D 2331/812* (2013.01)

(58) Field of Classification Search

CPC ..... F25D 3/08; A47F 3/0491

USPC ..... 62/258, 457.2, 457.6; 220/23.89, 23.88, 220/23.87, 23.86, 629, 630, 631, 505, 527, 220/528, 606, 608; 297/283.1, 283.2, 297/283.3; 206/514, 515, 518, 519, 505, 206/507

See application file for complete search history.

(56) References Cited

U.S. PATENT DOCUMENTS

| | | | | | |
|---|---|---|---|---|---|
| 3,356,085 | A | * | 12/1967 | Johnson | 126/37 R |
| RE27,649 | E | * | 5/1973 | Levenhagen | 206/507 |
| 4,711,356 | A | * | 12/1987 | Dunden | 206/503 |
| 5,332,286 | A | * | 7/1994 | Atherton et al. | 297/256.11 |
| 5,344,021 | A | * | 9/1994 | Rose | 206/505 |
| 5,701,757 | A | * | 12/1997 | Heverly | 62/457.2 |
| 6,065,646 | A | * | 5/2000 | Schwaikert | 222/143 |
| 6,145,333 | A | * | 11/2000 | Richmond et al. | 62/258 |
| 6,843,062 | B2 | * | 1/2005 | Crete | 62/60 |
| 6,851,274 | B2 | * | 2/2005 | Martino | 62/457.1 |
| 7,413,094 | B2 | * | 8/2008 | Cadiente et al. | 220/23.88 |
| 2008/0257927 | A1 | * | 10/2008 | Feick | 224/539 |
| 2009/0078699 | A1 | * | 3/2009 | Mustafa et al. | 220/1.5 |
| 2009/0178434 | A1 | * | 7/2009 | DeMirjian | 62/457.2 |

* cited by examiner

*Primary Examiner* — Cheryl J Tyler
*Assistant Examiner* — Antonio R Febles
(74) *Attorney, Agent, or Firm* — Marcus C. Dawes; Daniel L. Dawes

(57) ABSTRACT

A food service system is formed using a plurality of units capable of being interlocked together in a variety of customizable configurations. The units of the food service system include a food service bar with buffet pan chillers, a work table, a cashier station, and variety of connecting pieces for linking each of the units together. The food service bar comprises a sneeze guard that protects the food contained within the bar on three sides and can be broken down and folded down and into itself when the bar is being transported or stored. The buffet pan chillers are double sided and configured such that when frozen, may accommodate a shallow food pan on one side and then flipped over to accommodate a deep food pan on the other side while still maintaining the same serving height. Each unit is configured to receive multiple sizes of wheels or casters.

11 Claims, 17 Drawing Sheets

COLLAPSIBLE FOOD SERVICE SYSTEM

PRIORITY

The present application is a divisional of U.S. application Ser. No. 12/615,964, filed Nov. 10, 2009 and is related thereto under 35 USC 120.

BACKGROUND OF THE INVENTION

1. Field of the Invention

The invention relates to the field of food service bars for use in restaurants and cafeterias, and in particular to a food service bar that is capable of collapsing into a more compact shape for ease of transport and storage.

2. Description of the Prior Art

Food service bars have long been used in restaurants, school cafeterias, and by catering companies when a large amount of food is required to be served to a large amount of people. A food service bar can be made of any strong, durable, easy to clean material such as wood, glass, plastic or plastic composites, or any combination thereof.

Typically, a food service bar comprises a plurality of compartments or trays for holding a variety of foods and a means for keeping those foods at various desired temperatures. Some tray compartments may contain hot water for keeping the food contained within the tray warm or hot, while other trays may have ice in order to keep their foods cold. Additionally, the compartments may take on various shapes to accommodate different shaped food service trays or even other containers such as condiment or salad dressing dispensers.

Also included in nearly every food service bar is a sneeze guard which protects the food contained in the bar from unwanted contact from a user of the food service bar while still allowing the user access to the food. The sneeze guard may be set at a fixed angle or position or alternatively the guard may be adjustable to accommodate different users such as children.

Some bars contain wheels disposed on the bottom which allow the bar to be easily rolled in and out of a desired location, including locations that are outside. This is especially beneficial to caterers as mobility is a key aspect to their business.

Finally, many food service bars have tray rails or other surfaces in which a user may slide their food tray along as they are progressing along the bar and selecting their food. The tray rails are typically located at waist level of an average user and are permanently coupled to the food service bar itself.

While the food service bars containing one or more of the above described features are not without their respective applications, several limitations exist which severely limit their effective use. The sheer size of a food service bar can prove to be a hindrance when attempting to transport the bar from one location to another, particularly when traveling through a standard sized doorway or when loading or unloading the bar from a delivery vehicle. Also, many bars keep food cold by surrounding the food to be chilled with ice cubes which in addition to the ice easily melting when in direct sunlight and providing substandard cooling, presents a health risk as germs and other contaminants can become mixed in with the half-melted ice. Additionally, while many bars contain wheels, they lack the resiliency and structural durability to travel over rough terrain such as dirt paths and grass, or uneven pavement such as cobblestones. Furthermore, many food service bars can only operate as a single stand alone unit and cannot be customized with multiple other units or a plurality of attachments so as to be tailored to a specific situation.

What is needed is a food service system that overcomes the limitations found in the prior art while still meeting the expectation of ease of use and the health standards required of a food service bar.

BRIEF SUMMARY OF THE INVENTION

A food service system is formed using a plurality of units capable of being interlocked together in a variety of customizable configurations. The units of the food service system may include a food service bar with optional buffet chillers, a work table, a cashier station, and variety of connecting pieces for linking each of the units together. Each unit is made primarily of durable, lightweight rotationally molded plastic and is capable of being broken down into primary pieces for ease of cleaning and shipping. The food service bar comprises a sneeze guard that protects the food contained within the bar on three sides and can be broken down and folded away when the bar is being transported or not in use. Additionally, the food service bar comprises tray rails that may be locked into position and then broken down with a minimal amount of intervening steps and moving parts. The buffet chillers that may be inserted into the bar are double sided and configured such that when frozen, may accommodate a 2.5 inch deep food pan on one side and then flipped over to accommodate a deeper 4 inch food pan on the other side while still maintaining the same overall depth within the serving well of the bar. The cashier station is sufficiently large enough to accommodate a standard sized computer and is configured so as to allow sufficient space and access for computer and printer cables and the like. A variety of connector pieces such as an end table, a straight connector, and a corner connector allow the user to link multiple units together in any configuration for any situation as necessary. Finally, each unit is configured to receive multiple sizes of wheels or casters. The user may install the larger casters when the food service system is be used outside or when being transported over rough terrain, or they may install the smaller casters when being used in an indoor setting.

The current application is for a mobile and collapsible food service system comprising a food service bar with a main compartment comprising a longitudinal centerline, a pair of legs coupled to the bottom of the main compartment, a pair of tray rails coupled to either side of the main compartment, a plurality of hand holds defined into either end of the main compartment, and a collapsible sneeze guard assembly coupled to the main compartment.

The pair of tray rails comprise means for extending out into an extended flat position perpendicular to the centerline of main compartment and means for collapsing and folding down parallel against the centerline of the main compartment.

The collapsible sneeze guard assembly of the food service system comprises a pair of vertical end walls disposed on either end of the food service bar, a sneeze guard disposed on either side of the main compartment and wherein each sneeze guard comprises means to rotate about a fixed point on each of the end walls, and a pair of rotatable end panel guards coupled to each of the end walls and wherein each end panel guard comprises means to fold out to an angle within 30 degrees from a substantially perpendicular position to the centerline of the main compartment and means to fold to a minimum position substantially parallel to the centerline of the main compartment.

The sneeze guard assembly further comprises means for the sneeze guard disposed on either side of the main compartment to be supported and rest upon each of the end panel guards when the end panel guards are in their maximum position perpendicular to the centerline of the main compartment.

In another embodiment, the sneeze guard assembly further comprises means for the sneeze guard to hang down against each of the end walls when the end panel guards are in their minimum position substantially parallel to the centerline of the main compartment.

The food service bar further comprises a removable end table component that comprises means for coupling to the food service bar via the hand holds defined in the main compartment.

In another embodiment, the food service system further comprises a plurality of food service bars coupled together by means of at least one removable straight connector that comprises means for coupling to the plurality of food service bars via the hand holds defined in the main compartment.

In still another embodiment, the food service system further comprises a plurality of food service bars coupled together by means of at least one removable corner connector that comprises means for coupling to the plurality of food service bars via the hand holds defined in the main compartment.

In yet another embodiment, the food service system comprises that the main compartment of the food service bar further comprises a plurality of removable well covers disposed across the main compartment to provide a substantially flat table surface.

In another embodiment, the food service bar of the food service system comprises means for a plurality of casters of at least two different sizes to be interchangeably coupled to the bottom of the legs.

In a further embodiment, the food service bar further comprises a cashier station coupled to at least one food service bar.

The cashier station comprises a flat work surface, a drawer disposed beneath the flat work surface, and an interior cabinet volume disposed beneath the drawer.

In one embodiment, the flat work surface of the cashier station comprises an access port defined within the surface that allows access to the interior cabinet volume below. The drawer of the cashier stand itself comprises an adjustable keyboard insert coupled to an interior molding of the drawer.

It is further an aspect of the invention to provide a removable and freezable buffet pan chiller for maintaining a food pan at a reduced temperature, wherein the buffet pan chiller is shaped and configured to fit within the main compartment of a food service bar.

In one embodiment, the buffet pan chiller further comprises a pair of corner tabs disposed on one edge of the buffet pan chiller and a center tab disposed on the opposite edge of the buffet chiller so that a plurality of buffet pan chillers may be stacked upon one another in a substantially nested position.

In another embodiment, the buffet pan chiller comprises a pair of corner tabs disposed on one edge of the buffet pan chiller and a center tab disposed on the opposite edge of the buffet chiller so that when facing upwards, the buffet pan chiller may accommodate a first food pan with one depth, and then when flipped upside down, the buffet pan chiller may accommodate a second food pan with a differing depth than that of the first food pan. In this embodiment, the buffet pan chiller maintains the same serving height for both the first and second food pan.

It is further an aspect of the invention to provide a mobile and collapsible food service system comprising a food service bar with a main compartment comprising a longitudinal centerline, a pair of legs coupled to the bottom of the main compartment, a pair of tray rails coupled to either side of the main compartment, a plurality a of hand holds defined into either end of the main compartment, a collapsible sneeze guard assembly coupled to the main compartment, and a removable and freezable buffet pan chiller for maintaining a food pan at a reduced temperature, wherein the buffet pan chiller is shaped and configured to fit within the main compartment of a food service bar.

In this embodiment, the collapsible sneeze guard assembly comprises a pair of vertical end walls disposed on either end of the food service bar, a sneeze guard disposed on either side of the main compartment and wherein each sneeze guard comprises means to rotate about a fixed point on each of the end walls, and a pair of rotatable end panel guards coupled to each of the end walls and wherein each end panel guard comprises means to fold out to an angle within 30 degrees from a substantially perpendicular position to the centerline of the main compartment and means to fold to a minimum position substantially parallel to the centerline of the main compartment.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
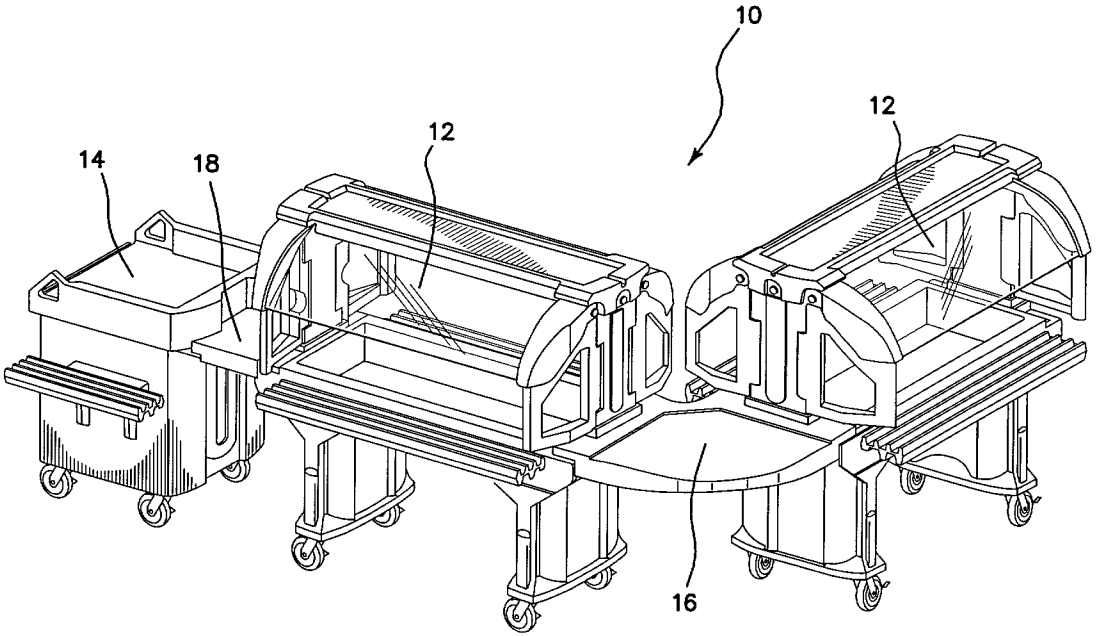
FIG. 1 is a perspective view of an example configuration of the food service system comprising a plurality of food service bars, a cashier stand, a corner connector, and a straight connector.
Figure 2:
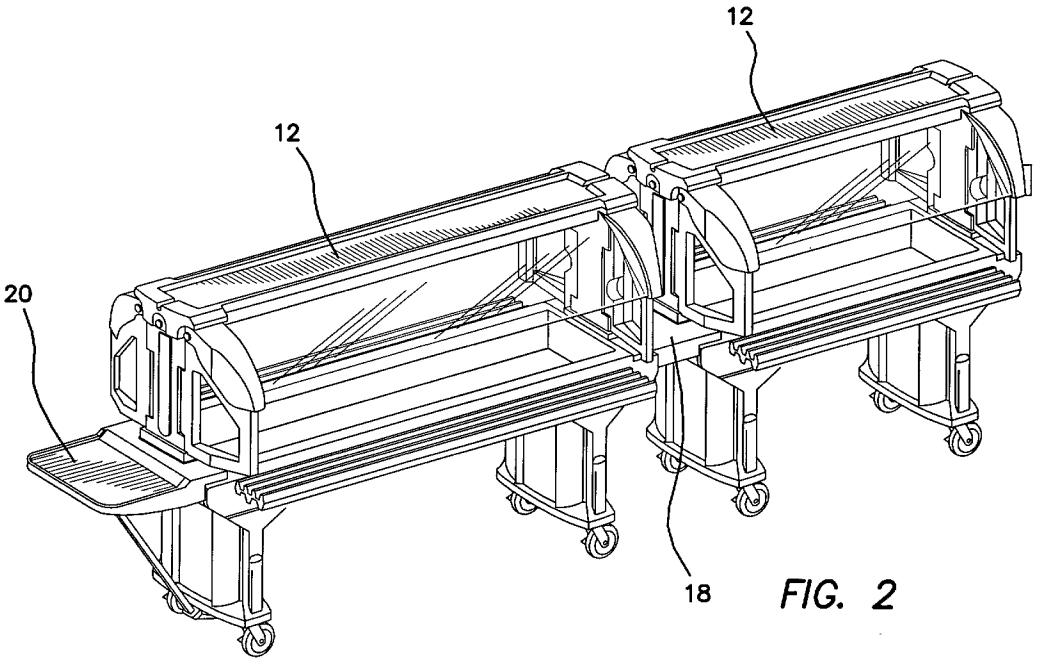
FIG. 2 is a perspective view of an alternative example of the food service system comprising a plurality of food service bars, a straight connector, and an end table.

A general understanding of the main embodiments can be found by turning to FIG. 1 which shows an example of one of the many possible configurations of the food service system, generally denoted by reference numeral 10. The food service system 10 comprises of one or more food service bars 12 and a cashier station 14. The food service bars 12 are linked together by a corner connector 16 and are then linked in turn to the cashier station 14 by a straight connector 18. It is to be expressly understood that fewer or more food service bars 12 may linked together by any combination or number of straight connectors 18 or corner connectors 16 without departing from the original spirit and scope of the invention. For example, an alternative food service system 10 is shown in FIG. 2 comprising two food service bars 12 coupled together by a straight connector 18. Also shown in FIG. 2 is an end table 20 which may be coupled to any free end of any one of the food service bars 12. The straight connectors 18, corner connectors 16, and end table 20 effectively extend a continuous usable surface of the food service system 10 and helps guides users through the system 10 as they are selecting their items from the food service bars 12.

The food service bars 12, the cashier station 14, the straight and corner connectors 16, 18 and end table 20 are all preferably comprised of rotationally molded plastic, however other materials now known or later devised may also be used. The use of molded plastic allows the various components to be light weight, yet durable and strong enough to withstand extended or outdoor use.

Figure 3:
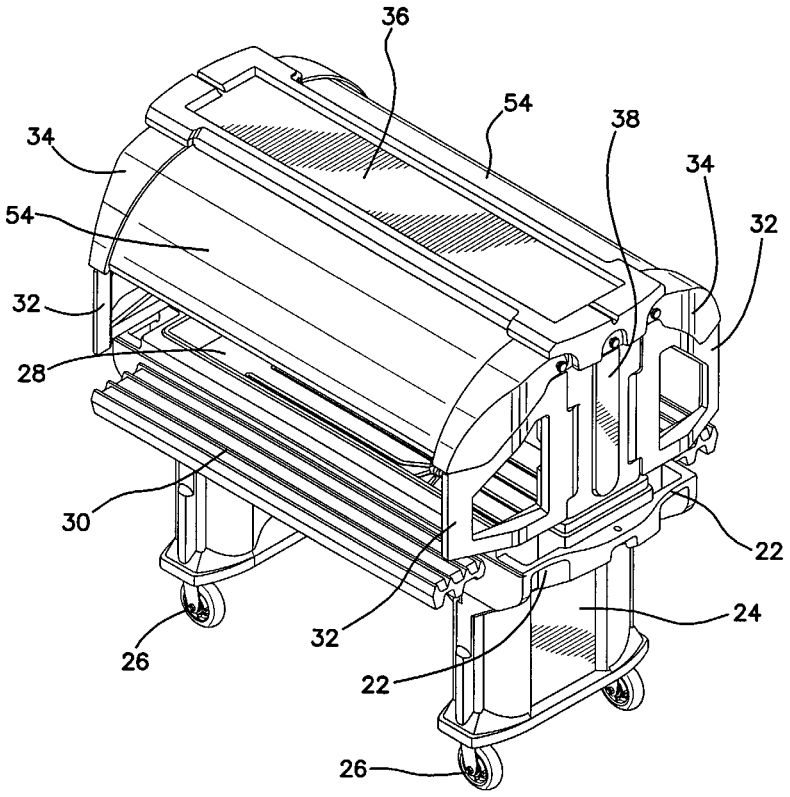
FIG. 3 is a perspective view of the food service bar when the tray rails and sneeze guard assembly are fully extended in their operating position.

The straight connectors 18, corner connectors 16, and end table 20 are stand alone pieces that may be coupled and removed to and from the food service bars 12 at will. In other words, the straight and corner connectors 18, 16 and end table 20 are interchangeable and may be placed anywhere in the food service system 10 according to the desires of the user. The straight connectors 18, corner connectors 16, and end table 20 are configured to be inserted and then locked into a pair of hand holds 22 disposed in the food service bar 12 as seen in FIG. 3. The straight connectors 18, corner connectors 16, and end table 20 may be inserted and locked into the hand holds 22 without any outside tools due to the specific shape of the hand holds 22 and the respective connective piece being inserted into it. The hand holds 22 can be substituted with openings to receive hooks, links or can be of any other mechanical means to link the food service bar 12 and assemblies together.

Figure 4:
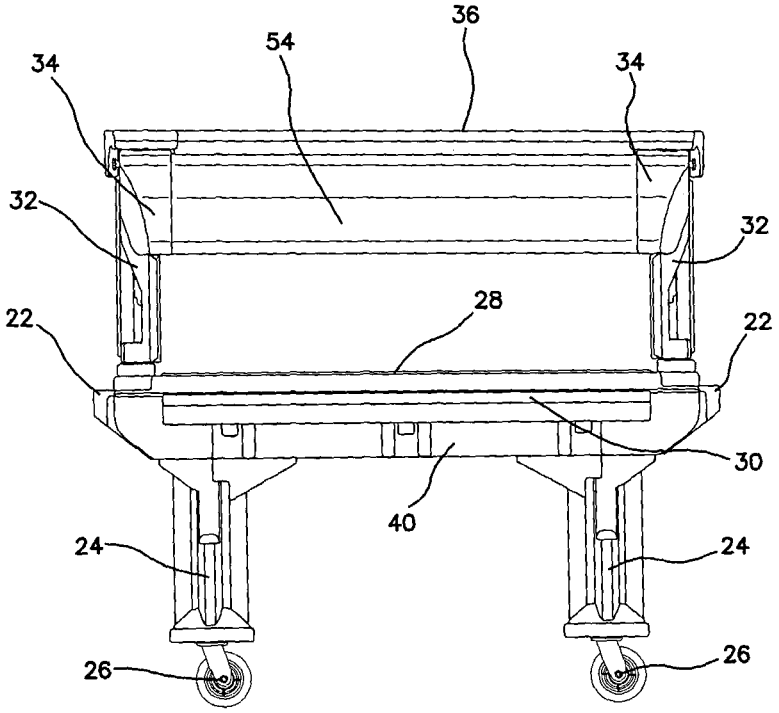
FIG. 4 is a side view of the food service bar when the tray rails and sneeze guard assembly are fully extended in their operating position.
Figure 5:
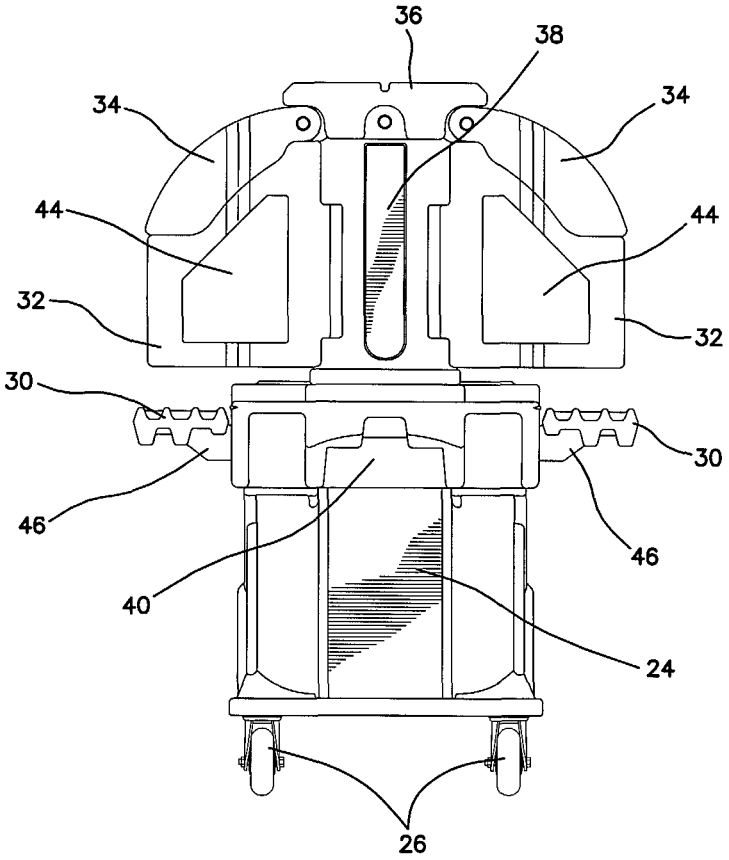
FIG. 5 is an end view of the food service bar when the tray rails and sneeze guard assembly are fully extended in their operating position.

A more complete understanding of the food service bar 12 may be had by turning to FIGS. 3-5. Each food service bar 12 comprises a main compartment 40 which in turn comprises a main food well 28 as best seen in FIGS. 3 and 4. The food well 28 shown in the drawings is rectangular, however it also contemplated that different shaped wells or a plurality of wells may also be used. Defined into either end of the main compartment 40 are a pair handles 22. In addition to serving as conduits for the various connecting pieces as disclosed above, the handles 22 allow the user to grip the food service bar 12 at a position where the possibility of inadvertently tipping over the bar 12 is the least likely.

Figure 23:
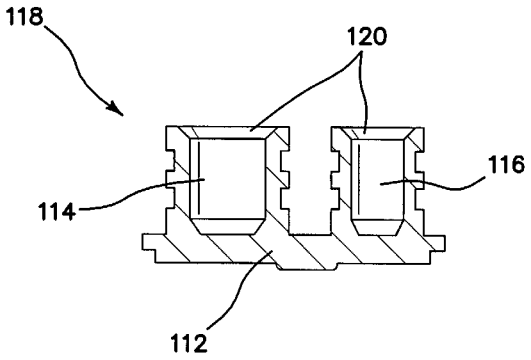
FIG. 23 is a cross sectional view of the caster insert plate that is disposed within the legs of the food service bar and cashier stand.
Figure 24:
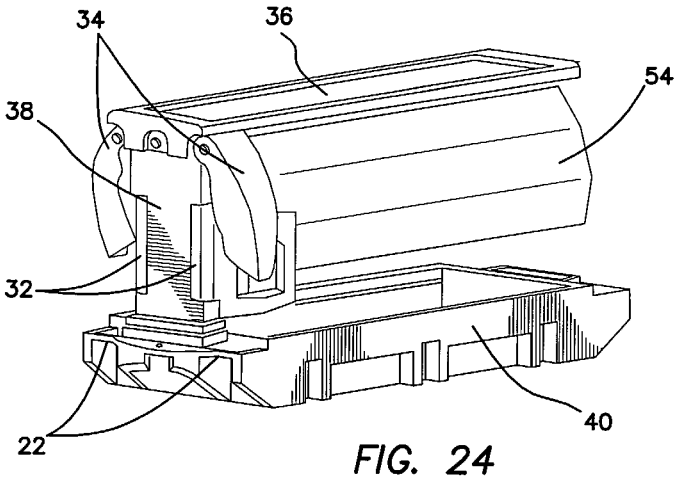
FIG. 24 is a perspective view of the main compartment and sneeze guard assembly of the food service bar.
Figure 25:
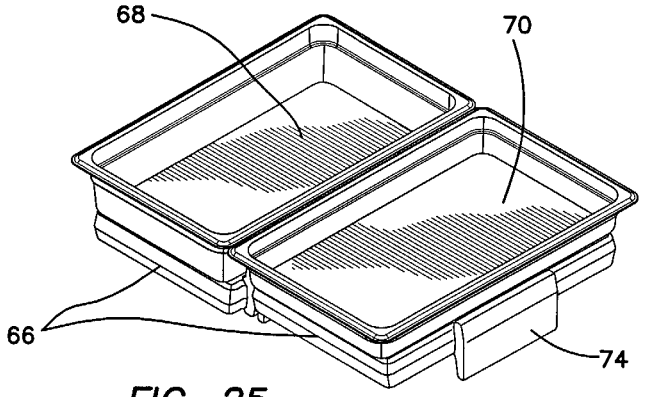
FIG. 25 is a perspective view of the buffet pan chillers shown in FIG. 13.

FIGS. 3 and 4 best show that at least two legs 24 are coupled to the main compartment 40. Disposed on each leg 24 are at least two casters 26 which allow the food service bar 12 to be mobile and to be pushed or pulled by a user via the handles 22. The size of the casters 26 can be changed to fit the particular needs of the user using the food service bar 12 by means of a caster insert plate 118 as seen in FIG. 23. The caster insert plate 118 comprises a large caster input 114 and a small caster input 116 coupled to a single caster base 112. The large and small inputs 114, 116 are equal in length and both comprise internal threading, however the large caster input 114 is approximately 25% bigger in diameter than the small caster input 116. The large and small caster inputs 114, 116 may be cylinder shaped as seen in FIG. 23, however other shapes such as hexagons, octagons, and other shapes common in industrial manufacturing may also be used. A set of caster insert plates 118 are coupled to each of the legs 24 so that the tops of the small and large caster inputs 120 are flush with the bottom surface of the leg 24. When the user wishes to use the food service bar 12 indoors on a flat surface such as tile or linoleum, a caster 26 known in the art is inserted into the small caster input 116 by threading the caster 26 to the internal thread defined within the small castor input 116. If the food service bar 12 is to be used outdoors or pushed along uneven surfaces such as cobblestones and the like, the user removes the caster 26 from the small caster input 116 and threads a different, larger caster 26 known in the art into the large caster input 114. Allowing the user to change the casters 26 allows increased flexibility in implementing the food service bar 12. Additionally, the ability to swap out casters 26 adds to the overall lifespan of the food service bar 12 as typically the first part to degrade and break down is the part that supports the most weight and makes the most contact with the surface.

Figure 6:
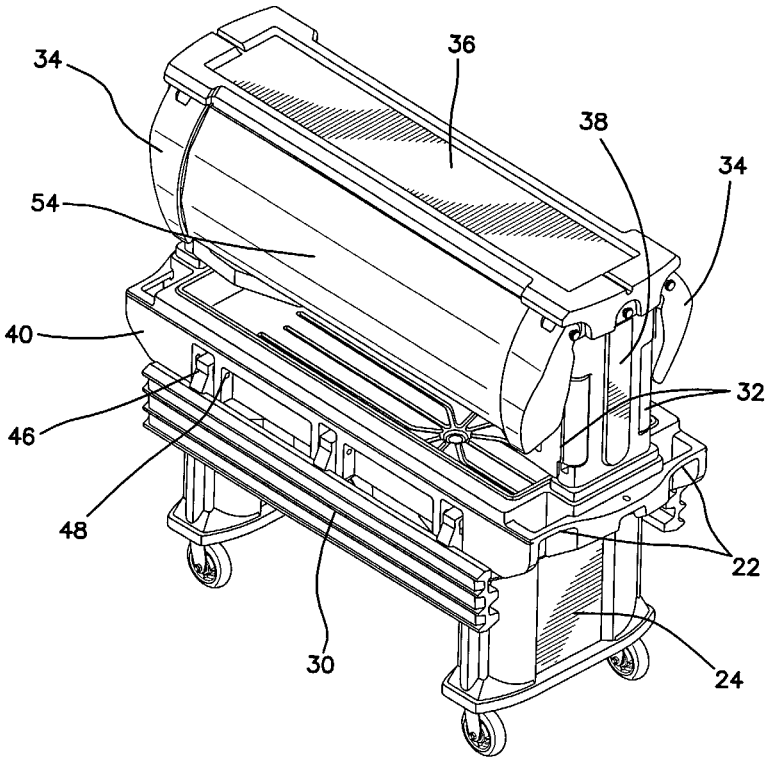
FIG. 6 is a perspective view of the food service bar when the tray rails and sneeze guard assembly are fully collapsed.
Figure 7:
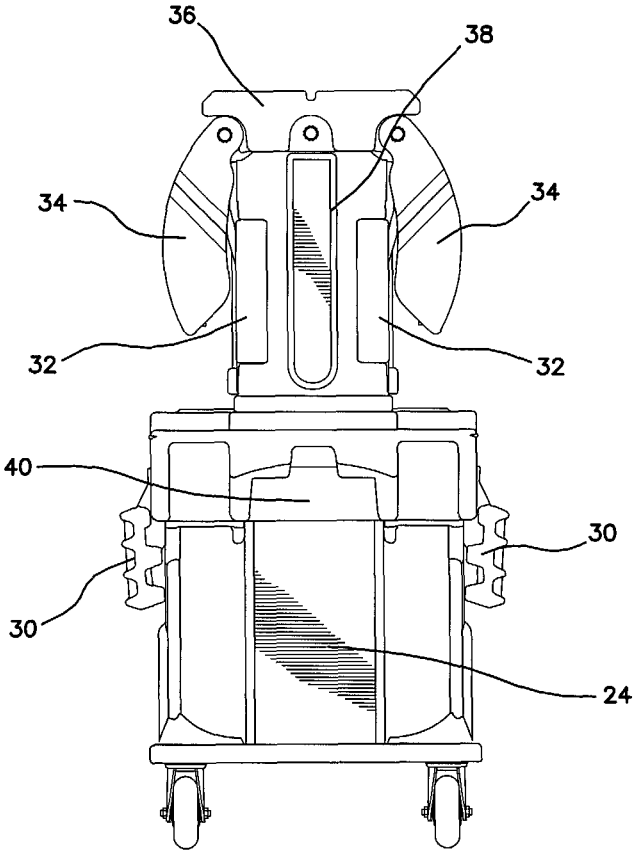
FIG. 7 is an end view of the food service bar when the tray rails and sneeze guard assembly are fully collapsed.

Also coupled to the main compartment 40 is a pair of tray rails 30, one on each side of the main compartment 40 as best seen in FIG. 5. Each of the tray rails 30 comprise a plurality of tray rail bridges 46 disposed on the bottom of the tray rail 30 that extend out in the same direction as seen in FIGS. 5 and 6. The tray rail bridges 46 are comprised of the same plastic material as the tray rails 30 and are preferably part of the molded tray rail 30 itself, thus forming a singular piece free of moving parts or welds. The tray rails 30 themselves are sized to sufficiently support a standard size food tray known in the art as they are slid down the length of the food service bar 12. The tray rails 30 are collapsible in that they can be manipulated to be folded down beneath the main compartment 40 and against the legs 24 as seen in FIG. 6. If the tray rails 30 are in the upright and locked position of FIG. 5, the user first unscrews or backs off a threaded fastener (not shown) on each outside rail bridge 46 to unlock the tray rail 30, then grips the tray rail 30 anywhere along its length and pulls the tray rail 30 out in the normal direction away from the main compartment 40. Pulling out the tray rail 30 pulls out the tray rail bridge 46 from a correspondingly shaped socket defined within the main compartment 40. With the tray rail bridge 46 free of the socket, the tray rail 30 as a whole is then free to rotate about a tray rail pin 48 disposed in the main compartment 40 as seen in FIGS. 6 and 7 and down towards the legs 24. The tray rail pin 48 is preferably comprised of a light weight durable metal such as aluminum and each tray rail bridge 46 comprises a hole for its respective tray rail pin 48 to be threaded therethrough. To set the tray rails 30 back in the upright position of FIG. 5, the user rotates the tray rails 30 about the tray rail pins 48. When the tray rail 30 is at a level that is normal to the main compartment 40, the user pushes the tray rail 30 into the main compartment 40 causing the tray rail bridges 46 to slide into each of their respective sockets. The shape of the sockets and the gravitational torque that is constantly being applied to the tray rails 30 causes the tray rails 30 to be effectively placed into position within the main compartment 40 and thus provides an even, stable surface suitable for supporting the weight of a user's loaded food tray. The threaded fastener on each outside rail bridge 46 is then tightened to lock the tray rail 30 from unwanted release. The whole process of assembling and disassembling the tray rails 30 into their upright and collapsed positions is done with a minimum of moving parts and metal components so as increase the ease of use as well as to cut down on overall manufacturing costs.

Figure 8:
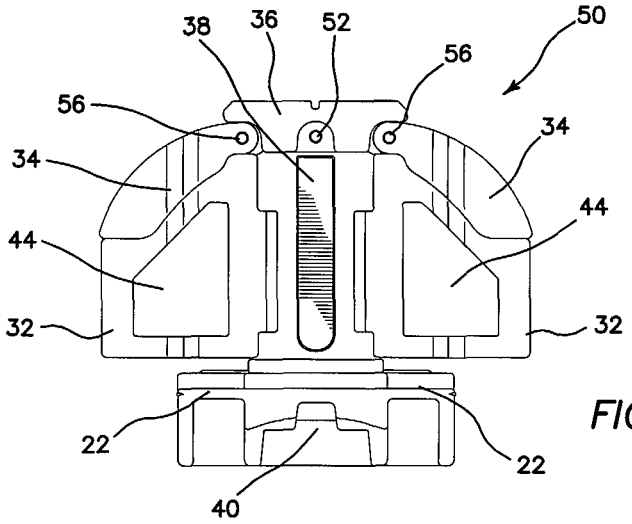
FIG. 8 is a detailed end view of the sneeze guard assembly when it is fully extended in its operating position.
Figure 9:
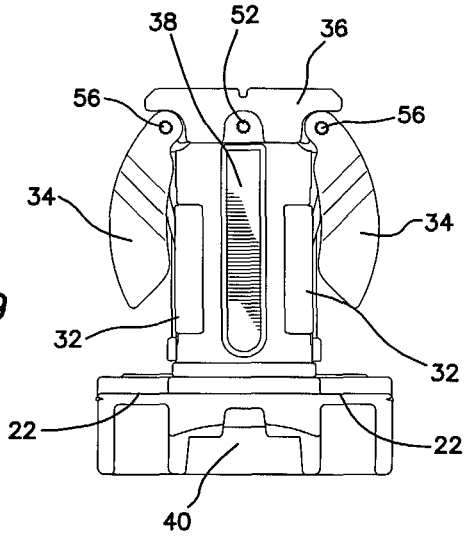
FIG. 9 is a detailed end view of the sneeze guard assembly when it is fully collapsed.

The food service bar 12 also comprises a foldable and collapsible sneeze guard assembly 50 as seen in its extended and collapsed configurations in FIGS. 8 and 9 respectively. The sneeze guard assembly 50 comprises a pair of swing down sneeze panels 54, a pair of end guard panels 32 for each of the sneeze panels 34, a pair of end walls 38 disposed on either end of the food service bar 12, and a cap 36 that extends between the end walls 38 and suspended in the air above the food well 28 below. Each of the end walls 38 are coupled to the main compartment 40 at either end of the food service bar 12 seen in FIG. 4 by any removable means now known or later devised that allow the end walls 38 to be easily placed and re-placed by the user in order to conform to their present will and to assist in the ease of cleaning. The cap 36 is in turn coupled to the top portions of each of the end walls 38 by means of an adjustable thumb screw 52. Should the user desire the sneeze guard assembly 50 to be broken down, the thumb screw 52 is loosened and the cap 36 may then be freely removed.

The sneeze guard assembly 50 is seen in its extended configuration in FIGS. 3, 5, and 8. Here it is seen that each end guard panel 32 are in their maximum extended position substantially perpendicular to the longitudinal centerline of the main compartment 40 and form a solid end piece along with the end wall 38 that they are coupled to at each end of the food service bar 12. If both sets of end guard panels 32 are extended from both sides of the end wall 38, it can be seen in FIG. 5 that protection from the outside elements is extended from the tray rail 30 on one side of the food service bar 12 to the tray rail 30 disposed on the opposite side of the food service bar 12. It can also be seen in FIGS. 5 and 8 that each end guard panel 32 comprises a window 44 substantially shaped like the end guard panel 32 itself. The windows 44 are preferably comprised of clear plastic or plastic composite, however other light weight materials resistant to scratching and breaking may also be used. The end guard panels 32 are also shaped to accommodate an end segment 34 disposed on each end of the sneeze guard panels 54 as best seen in FIG. 4 in a tight and secure fit. The end guard panels 32 serve as vertical supports for the sneeze guard 54 with the end segments 34 resting in the indentations defined in the end guard panels 32. Each end guard panels 32 can fold outwardly to support the sneeze guard panel 54 to an angle up to 30 degrees on either side of the substantially perpendicular to the longitudinal centerline position described above, as long as it underlies and supports the sneeze guard panel 54 above it. Each end segment 34 of the sneeze guard panel 54 is comprised of the same rotationally molded plastic as the other components of the food service system 10, however the material between the end segments 34 that comprises the majority of sneeze guard 54 is the same clear plastic material or plastic composite material comprising the windows 44. It is in this fashion that the food service bar 12 provides protection on three sides but still allows users direct access to the food stuffs contained within the food well 28.

When the food service bar 12 is to be transported or stored away, the user lifts up on the sneeze panel 54 rotating it about a pin 56 disposed between it and the end wall 38. With the end segments 34 now lifted out of the fitted indentations defined in the end guard panels 32, the end guard panels 32 are then swung about a joint disposed within the end wall 38 much like a door until they are parallel with the longitudinal center line of the main compartment 40. After this process is repeated on the other end of the food service bar 12, the sneeze panel 54 may then be dropped against the end walls 38 as seen in FIGS. 6, 7, 9, and 25. The entire procedure may then be repeated on the other side of the food service bar 12, thus reducing the overall width of the food service bar 12 to a much more compact and compressed footprint.

Collapsing the sneeze guard assembly 50 and both tray rails 30 as described above reduces the overall width of the food service bar 12 by more than 27%, thus allowing it pass through standard 3 foot wide doorways. Decreased width also allows for more efficient storage within a storage space as well as increased ease of use when transporting the food service bar 12 to a distant location in a delivery vehicle.

To extend the sneeze guard assembly 50 back into its fully deployed position from the collapsed position shown in FIGS. 6, 7, and 9, the sneeze panel 54 and end segments 34 are lifted by rotating them about pin 56. The sneeze panel 54 and end segments 34 are lifted sufficiently high enough so that each end guard panel 32 may then be swung out until they are substantially perpendicular to the longitudinal centerline of the main compartment 40. Once the end guard panels 32 are fully extended, the sneeze panel 54 and end segments 34 are lowered until the end segments 34 are once again snugly nested into the defined top surfaces of the end guard panels 32 as seen in FIGS. 3, 5, and 8.

Figure 10:
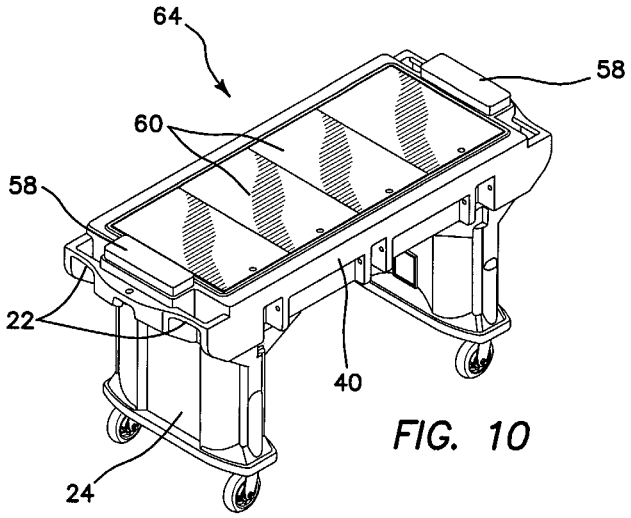
FIG. 10 is a perspective view of the service table embodiment of the food service bar.
Figure 11:
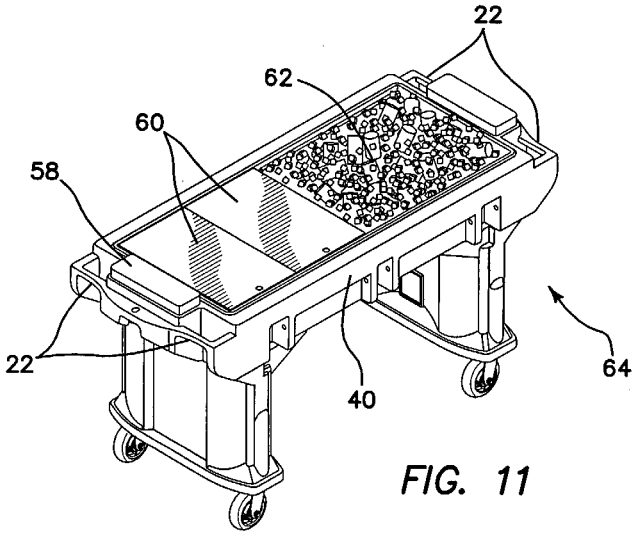
FIG. 11 is a perspective view of the service table embodiment of the food service bar when a plurality of well covers have been removed from the service table allowing food stuffs to be stored within the service table.

In an alternative embodiment, the food service bar 12 may be converted into a service table 64 as seen in FIGS. 10 and 11. As discussed above, the sneeze guard assembly 50 may be removed leaving the main compartment 40 and legs 24 behind. A pair of wall caps 58 are then placed into the empty positions that the end walls 38 once occupied at either end of the service table 64. The wall caps 58 close any open gaps left behind by the removal of the end walls 38 as well as provide a more atheistically appealing look to the service table 64. A plurality of well covers 60 are then placed over the open food well 28 defined within the main compartment 40. In FIG. 10, four well covers 60 are shown, however fewer or more well covers 60 of various sizes may be used without departing from the original spirit and scope of the invention. With the well covers 60 in place, the service table 64 may be used as a preparation table, display station, or for any other application that requires a table with a stable, flat surface. Alternatively as seen in FIG. 11, one or more or the well covers 60 may be removed leaving an opening available into the main compartment 40 for the placement of various self-serve items 62 while the remaining well covers 60 may be left in place thus providing a self-service station with an available flat display surface. The service table 64 may be coupled to any plurality of connectors or other components of the food service system 10 of FIGS. 1 and 2 in the same manner described above for the food service bar 12.

A deeper understanding of the buffet chiller that may be optionally inserted into the food service bar 12 or service table 64 may be had by turning to FIGS. 12-14, and 26 which show the buffet chiller generally denoted by reference numeral 66. The buffet chiller 66 is generally in the form of a box or book shape and is made of durable light weight plastic and comprises at least one hollow compartment with internal dividers to create at least three separate portions or sub-compartments. Each sub-compartment within the buffet chiller contains refrigerant gel or liquid commonly used in the art for ice packs and other like applications. When placed in a freezer, the refrigerant gel freezes within the buffet chiller 66. When taken out of the freezer, the frozen gel then keeps the buffet chiller 66 and anything resting on the buffet chiller 66 at a sufficiently low temperature for a number of hours. The internal dividers keep the refrigerant gel within each of the internal sub-compartments from mixing and collecting in one end of the buffet chiller 66 when the buffet chiller 66 is placed on end or on either of its sides.

Figure 12:
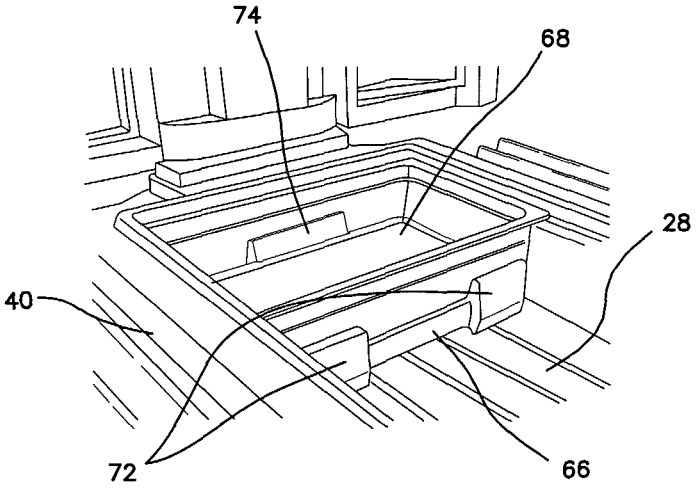
FIG. 12 is magnified view of the food well of the food service bar comprising a buffet pan within a buffet pan chiller.
Figure 13:
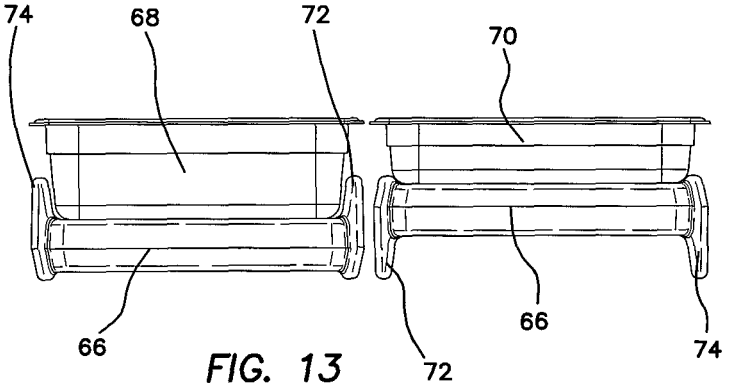
FIG. 13 is a pair of end views of the buffet pan chiller, each end view corresponding to when a deep or shallow buffet pan is placed within the chiller and demonstrating that regardless of what either buffet pan is used, a constant serving height is maintained for both buffet pans.
Figure 14:
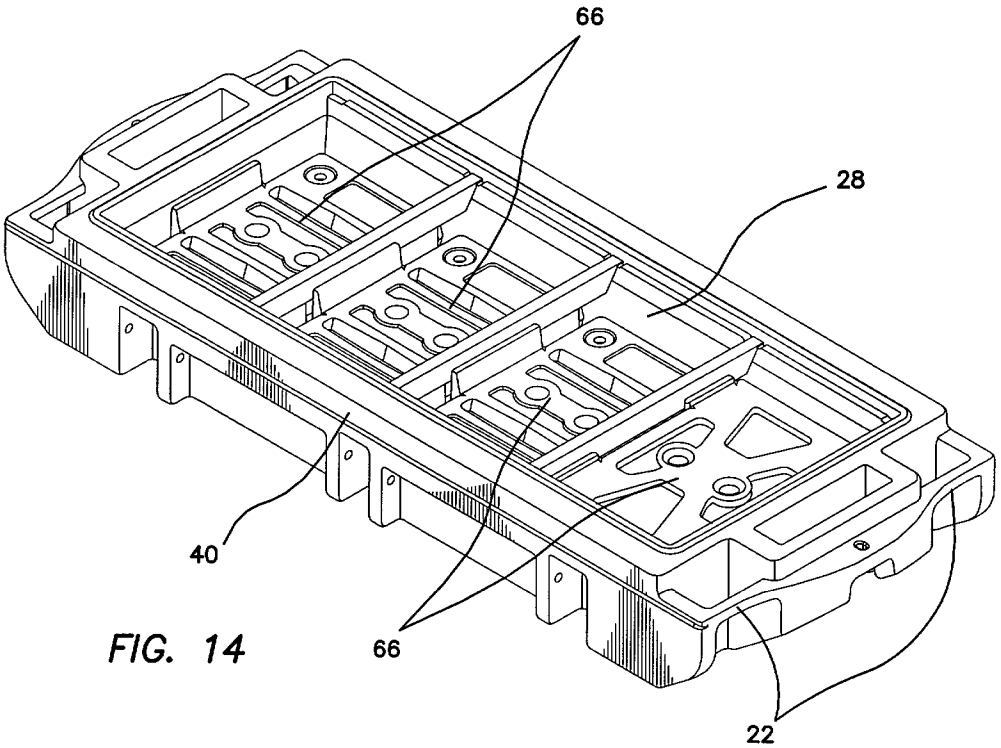
FIG. 14 is a perspective view of the main compartment of the food service bar with a plurality of buffet pan chillers disposed therein.

As seen in FIG. 12, the buffet chiller 66 comprises a pair of corner tabs 72 disposed near the corners of one side of the buffet chiller 66 and a center tab 74 disposed in the center of the opposite side of the buffet chiller 66. Both the corner tabs 72 and the center tab 74 are roughly equal with one face of the buffet chiller 66 but then extend approximately 1.5 inches above the opposite face of the buffet chiller 66. The purpose for the corner tabs 72 and the center tab 74 on either sides of the buffet chiller 66 being unequally disposed with respect to the faces of the buffet chiller 66 is so that when the tabs 72, 74 are extending upward, the chiller 66 may accommodate a four inch deep food pan 68, and when turned upside down with the tabs 72, 74 extending downward, the chiller 66 may accommodate a 2.5 inch deep food pan 70 and yet still maintain the same serving height as when the four inch deep pan 68 is placed as seen in FIGS. 13 and 26. Thus it can be seen when a plurality of buffet chillers 66 are placed within the food well 28 of the main compartment 40 as seen in FIG. 14, a variety of different foods requiring different sized food pans may be placed and yet may all maintain a uniform serving height and appearance while still being kept at a cool temperature from the buffet chiller 66.

The corner tabs 72 and center tab 74 also provide a symmetry to the buffet chiller 66 which allows a plurality of buffet chillers 66 to be efficiently stacked or stored within a small volume. The user flips and rotates the top most buffet chiller 66 so that the center tab 74 of the top chiller 66 can be nested between the corner tabs 72 of the chiller 66 beneath it. This process of alternating the orientation of the chillers 66 may be repeated indefinitely. The resulting shape of the stacked chillers 66 is a solid, compact form that is ideal for storage or transport or for when trying to maximize space within a freezer as the buffet chillers 66 are being frozen.

Figure 15:
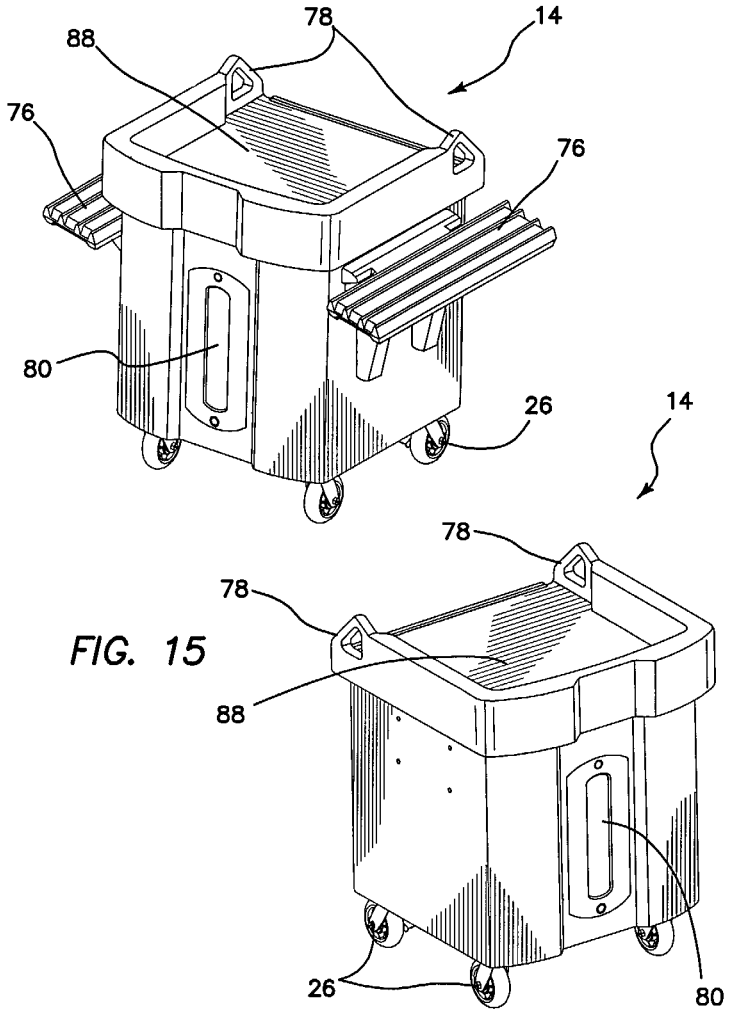
FIG. 15 is a left and right perspective views of the cashier stand, the right perspective view with the tray rails fully extended in their operating position, the left perspective view without the tray rail embodiment.
Figure 16:
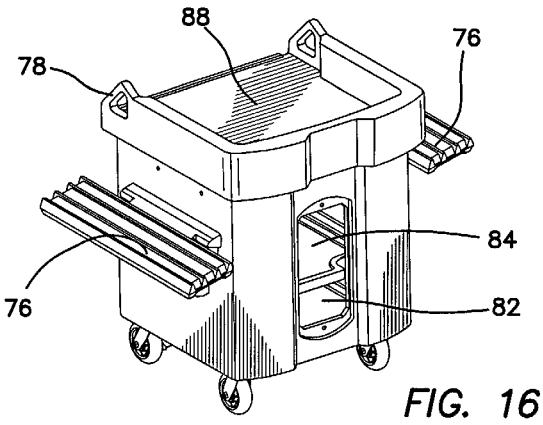
FIG. 16 is a left perspective view of the cashier stand with the tray rails fully extended in their operating position when the access panel has been removed from the cashier stand.
Figure 17:
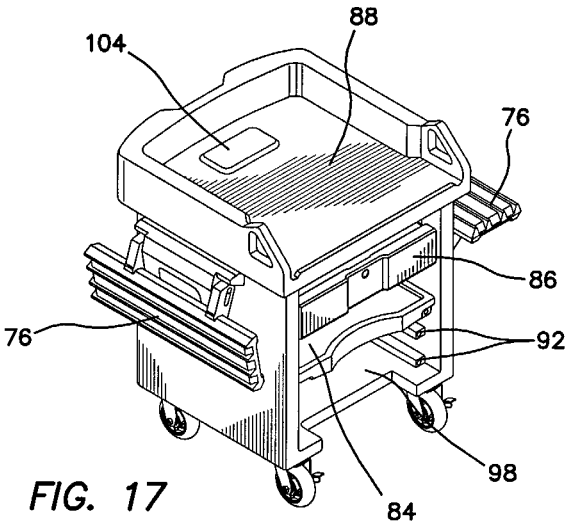
FIG. 17 is a rear perspective view of the cashier stand with one of the tray rails in its fully extended operation position and the other tray rail in its fully collapsed position.

Better understanding of the cashier station 14 may be had by turning to FIG. 15. The cashier station 14 is substantially square or box shaped with a plurality of casters 26 disposed beneath to increase mobility and ease of use by a user. The casters 26 coupled to the cashier station 14 are preferably interchangeable as discussed above with respect to the food service bar 12. The cashier station 14 preferably comprises a pair of handles 78 defined into the top of the station 14 and a plurality of side rails 76 disposed on either side of the station 14. The side rails 76 are comprised of the same material as the tray rails 30 of the food service bar 12, and are collapsible as seen in FIG. 17 by the same means described above with respect to the tray rails 30 of the food service bar 12. The side rails 76 on either side of the cashier station 14 may be at staggered or unequal heights as seen in FIGS. 15-18 or they may be at the same or equal height as seen in FIG. 19. Alternatively, the cashier station 14 may have no side rails 76 at all as seen in the second embodiment of FIG. 15.

The cashier station 14 also comprises a removable access panel 80 disposed in the front of the cashier station 14. To remove the access panel 80, a user standing at the front of the cashier station 14 removes two fasteners (not shown) on the face area of the access panel 80 and pops out the access panel 80 from an access aperture 82 as seen in FIG. 16. The user is then free to reach or gain access to items such as wires, switches, and the like from either side of the cashier station 14 at will and bring them closer to the user.

The rear or user space of the cashier station 14 can best be seen by now turning to FIGS. 17-20. The top of the cashier station 14 is a flat surface 88 that is substantially large enough to provide ample space for a user to perform various tasks such as food check-out service which may include the use of a computer or register screen 90 as seen in FIG. 19.

Figure 18:
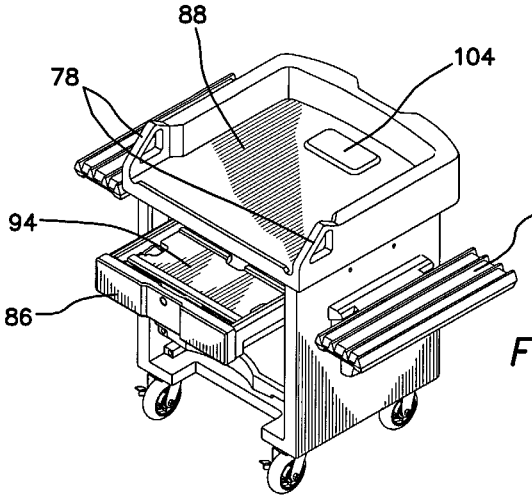
FIG. 18 is a rear perspective view of the cashier stand with the drawer extended from the cabinet of the cashier stand.
Figure 19:
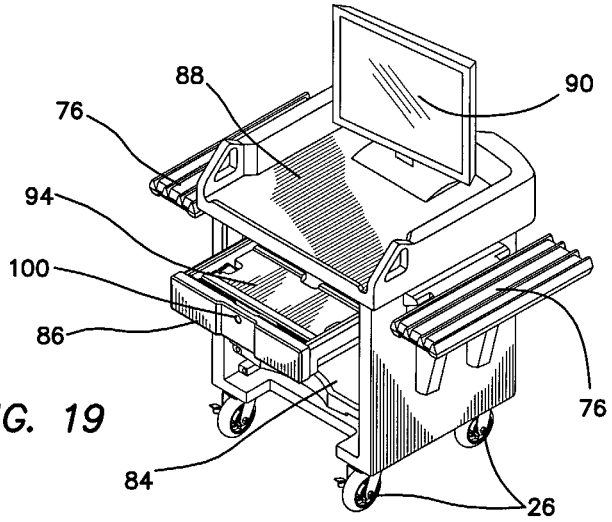
FIG. 19 is a rear perspective view of the cashier stand with the drawer extended from the cabinet of the cashier stand and an optional keyboard monitor disposed on top of the cashier stand.
Figure 20:
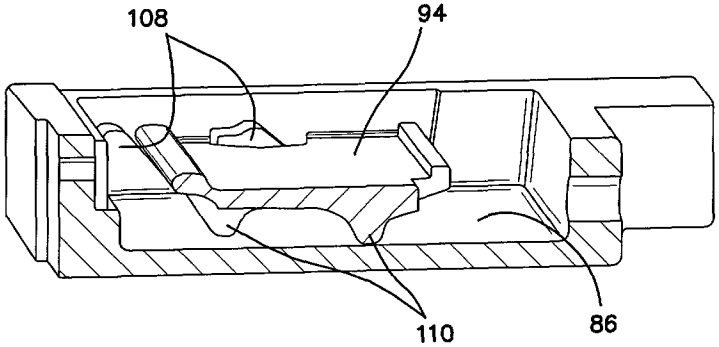
FIG. 20 is a perspective cross sectional view of the cashier stand drawer when the keyboard insert is at its minimum position on the bottom of the drawer.
Figure 21:
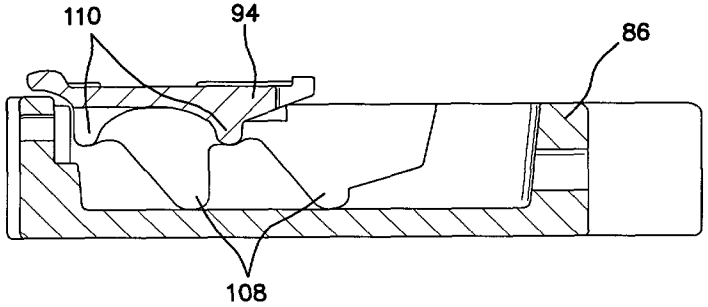
FIG. 21 is a cross sectional view of the cashier stand drawer when the keyboard insert is at its maximum position at the top of the drawer.
Figure 22:
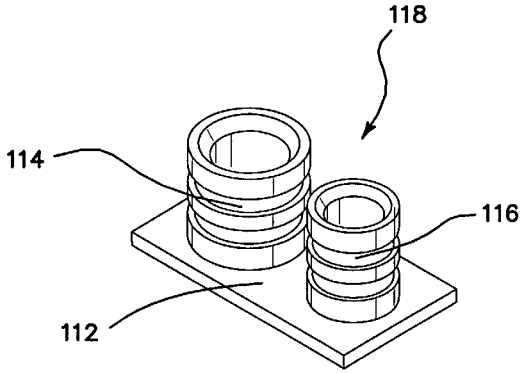
FIG. 22 is a perspective view of the caster insert plate that is disposed within the legs of the food service bar and cashier stand.

Beneath the flat surface 88, is a large drawer 86 sufficiently sized to fit a standard cash box or tray or a keyboard insert 94 as seen in FIGS. 18 and 19. A cross section of the inside of the drawer 86 may be seen in FIGS. 20 and 21. The drawer 86 comprises a drawer track 108 defined on each of the inner side walls of the drawer 86. The keyboard insert 94 correspondingly comprises an insert molding 110 disposed on the bottom of the insert 94. The insert molding 110 is sufficiently sized and shaped to fit within the drawer track 108. If the keyboard insert 94 is on the bottom of the drawer 86 as seen in FIG. 20, the user may pull on the insert 94 in the proximal direction. As the keyboard insert 94 moves in the proximal direction, the insert molding 110 moves up the drawer track 108. The drawer track 108 is sufficiently sloped at an incline which then guides the keyboard insert 94 up to the top of the drawer 86 as seen in FIGS. 18-21. With the keyboard insert 94 resting on top of the drawer track 108, the user may use the insert 94 as a support surface for a keyboard of the computer 90 or as a optional writing surface. To replace the keyboard insert 94, the user pushes on the insert back in the distal direction, moving the insert molding 110 back down the drawer track 108. The keyboard insert 94 is pushed distally until it is fully pushed down the drawer track 108 and is resting on the bottom of the drawer 86 as seen in FIG. 20. At this point the drawer 86 may be closed, thus keeping the keyboard and keyboard insert 94 safely and conveniently out of the workspace of the user. The drawer 86 also comprises a lock 100 that is capable of keeping the drawer 86 securely locked when in the closed position.

Defined within the cashier station 14 beneath the drawer 86 is an interior cabinet. The interior cabinet extends from beneath the drawer 86 down to the cabinet floor 98 of the cashier station 14. Disposed on the interior walls of the cabinet are a plurality of shelf rails 92. The shelf rails 92 are configured to provide matching left and right surfaces for a removable shelf 84 to be slideably coupled thereto. For example, if the shelf 84 is on the lowest pair of shelf rails 92 the user may adjust the position of the shelf 84 by sliding the shelf 84 in the proximal direction until the shelf is completely clear of the cabinet of the cashier station 14. The user then selects a new height for the shelf 84 that is different from the original height and slides the shelf 84 back in the distal direction until the shelf 84 is completely confined within the cabinet as seen in FIG. 17. While the relevant figures show three shelf 84 positions, each with a corresponding pair of shelf rails 92, it is to be expressly understood that fewer or more shelf 84 positions may be present within the cabinet without departing from the original spirit and scope of the invention. It is in this fashion that a variety of uses may be had for the cabinet including as storage space or as a platform for housing any number of work related electronics including a printer, fax machine, or a processing unit for the computer 90.

An access port 104 is defined within the flat surface 88 as seen in FIGS. 17 and 18. The access port 104 allows the user to run various wires or cables from the cabinet beneath the surface 88 up and through the flat surface 88 and into any number of peripherals including computer 90. When not needed or not in use, the access port 104 may be covered with a plug (not shown). The plug is a solid single component comprised of the same light weight rotationally molded plastic as the cashier station 14 and is sized and shaped to snuggly fit within the access port 104. To remove the plug, the user reaches beneath the flat surface 88 and pushes upward on the plug until it effectively pops out of the access port 102. When installed, the plug allows the user maintain a consistent flat work area across the entirety of the surface 88 without sacrificing direct accessibility to the cabinet below.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention and its various embodiments.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

a. The claims are thus to be understood to include what is specifically illustrated and described above, what is conceptionally equivalent, what can be obviously substituted and also what essentially incorporates the essential idea of the invention.

I claim:

1. A removable and freezable buffet pan chiller for maintaining a food pan at a reduced temperature, wherein the buffet pan chiller is shaped and configured to fit within the main compartment of a food service bar and comprises:

a first surface and a second surface, wherein each surface is configured to accommodate the food pan thereon; and at least one internal hollow compartment configured to accommodate a refrigerant disposed between the first and second surfaces, wherein the first surface comprises a pair of corner tabs disposed on a first edge of the first surface and a center tab disposed on a second edge of the first surface, wherein the pair of corner tabs on the first edge are aligned to symmetrically correspond with the center tab disposed on the second edge so that a gap disposed between the pair of corner tabs on the first edge directly opposes the center tab on the second edge across the first surface, and wherein the pair of corner tabs and center tab are disposed so as to be substantially co-planar with the first surface and extend beyond the second surface.

2. The buffet pan chiller of claim 1 where the pair of corner tabs disposed on the first edge of the buffet pan chiller and the center tab disposed on the second edge of the buffet chiller are arranged so that when facing upwards, the buffet pan chiller can accommodate a first food pan with one depth, and then when turned upside down, the buffet pan chiller can accommodate a second food pan with a differing depth than that of the first food pan.

3. The buffet pan chiller of claim 2 where the buffet pan chiller maintains the same serving height for both the first and second food pan.

4. A food service bar device configured to maintain a buffet pan at a reduced temperature comprising:

a first surface;

a second surface disposed on the opposite side of the first surface;

at least one internal hollow compartment configured to accommodate a refrigerant;

at least two corner tabs disposed on a first lateral side of the device; and a center tab disposed on a second lateral side of the device, wherein the first and second surface are each configured to accommodate the buffet pan thereon, and wherein the at least two corner tabs on the first lateral side are aligned to symmetrically correspond with the center tab disposed on the second lateral side so that a gap disposed between the at least two corner tabs on the first lateral side directly opposes the center tab on the second lateral side across the second surface.

5. The device of claim 4 where the pair of corner tabs and center tab are substantially co-planar with the first surface and extend beyond the second surface of the device.

6. The device of claim 4 where the at least one internal hollow compartment comprises a plurality of separate internal sub-compartments containing refrigerant gel.

7. The device of claim 4 further comprising means for accommodating a first buffet pan when the first surface of the device is turned upward.

8. The device of claim 7 further comprising means for accommodating a second buffet pan when the second surface of the device is turned upward, the second buffet pan comprising a larger depth than that of the first buffet pan.

9. The device of claim 4 further comprising means for maintaining a constant serving height when a first buffet pan is accommodated on the first surface and when a second buffet pan is accommodated on the second surface, the second buffet pan comprising a larger depth than that of the first buffet pan.

10. A buffet pan chiller comprising:

a first surface;

a second surface disposed parallel to the first surface to form a hollow compartment disposed there between, the hollow compartment comprising at least one internal divider;

a pair of corner tabs disposed on a first lateral edge of the hollow compartment; and a center tab disposed on a second lateral edge of the hollow compartment, the second lateral edge being disposed parallel to the first lateral edge, wherein the pair of corner tabs are symmetrically disposed on the first lateral edge with regard to the center tab disposed on the second lateral edge so that a gap disposed between the pair of corner tabs on the first lateral edge directly opposes the center tab on the second lateral edge across the second surface.

11. The buffet pan chiller of claim 10 wherein the pair of corner tabs and the center tab are substantially co-planar with the first surface and extend beyond the horizontal plane of the second surface so as to accommodate a first food pan on the first surface at the same serving height as a second food pan that is deeper than the first food pan on the second surface when the buffet pan chiller has been inverted.

* * * * *